US007272330B2

(12) United States Patent
Harlan et al.

(10) Patent No.: US 7,272,330 B2
(45) Date of Patent: Sep. 18, 2007

(54) SYSTEM FOR ANALYZING AN ORGANIC PHOTOCONDUCTING DRUM AND A METHOD THEREOF

(75) Inventors: Andrij Harlan, Penfield, NY (US); Simon M. Jessop, Victor, NY (US); Nabil Z. Nasr, Pittsford, NY (US)

(73) Assignee: Rochester Institute of Technology, Rochester, NY (US)

( * ) Notice: Subject to any disclaimer, the term of this patent is extended or adjusted under 35 U.S.C. 154(b) by 0 days.

(21) Appl. No.: 11/110,044

(22) Filed: Apr. 20, 2005

(65) Prior Publication Data

US 2005/0249512 A1 Nov. 10, 2005

Related U.S. Application Data

(60) Provisional application No. 60/563,666, filed on Apr. 20, 2004.

(51) Int. Cl.
*G03G 15/00* (2006.01)

(52) U.S. Cl. ..... 399/26; 399/81; 399/116

(58) Field of Classification Search ..... 399/26, 399/116, 81

See application file for complete search history.

(56) References Cited

U.S. PATENT DOCUMENTS 6,108,499 A * 8/2000 Cernusak ..... 399/26
6,586,945 B1 7/2003 Geurts
6,904,243 B2 * 6/2005 Smith et al. ..... 399/26
2002/0021123 A1 * 2/2002 Kawamorita et al.
2003/0147658 A1 * 8/2003 Shin et al. ..... 399/26

FOREIGN PATENT DOCUMENTS

JP 2003195701 A * 7/2003

OTHER PUBLICATIONS

Tse et al., "A Methodology for Assessing the Reusability of Recycled Organic Photoconductive Drums for Laser Printers," Presented at the IS&T's NIP12, *International Conference on Digital Printing Technologies*, San Antonio, Texas, Oct. 17-Nov. 1, 1996.

* cited by examiner

*Primary Examiner*—Susan Lee
(74) *Attorney, Agent, or Firm*—Nixon Peabody LLP

(57) ABSTRACT

A system for analyzing an organic photo conducting drum includes an identification system, a feature examination system, and an evaluation processing system. The identification system identifies one or more characteristic relating to the organic photo conducting drum. The feature examination system examines one or more features of the organic photo conducting drum. The evaluation processing system provides an analysis of the organic photo conducting drum based on the identified one or more characteristics and the examined one or more features.

32 Claims, 9 Drawing Sheets

SYSTEM FOR ANALYZING AN ORGANIC PHOTOCONDUCTING DRUM AND A METHOD THEREOF

This application claims the benefit of U.S. Provisional Patent Application Ser. No. 60/563,666, filed Apr. 20, 2004, which is hereby incorporated by reference in its entirety

FIELD OF THE INVENTION

This invention generally relates to evaluation devices for printing systems and, more particularly, to a system for analyzing an organic photoconducting (OPC) drum and a method thereof.

BACKGROUND

A coating layer on an OPC drum in a printing system acts as a charge transfer layer. During printing operations, the coating layer of the OPC drum is slowly worn down. Typically, this wear rate is about one micron per one-thousand pages and one life cycle of an OPC drum is usually about ten-thousand printed pages. Often after one life cycle, the OPC drum is disposed of, even though the OPC drum may have multiple life cycles left.

Attempts have been made to determine which OPC drums may have additional life cycles remaining, but these attempts have not been successful. For example, after use an OPC drum may be visually inspected for obvious flaws. If the OPC drum does not appear to be damaged, then the OPC drum is reused. Additionally, a manual measurement of the coating thickness may be taken and if the operator believes there is enough coating left to complete an additional life-cycle, then the OPC drum may be reused.

Unfortunately, these prior techniques are often inaccurate in analyzing the remaining life span of an OPC drum. Additionally, these techniques can be time consuming and thus the OPC drum is more likely to be replaced, then reused even though remaining life cycles may be available.

SUMMARY

A method for analyzing an organic photo conducting drum in accordance with embodiments of the present invention includes identifying one or more characteristics relating to the organic photo conducting drum and examining one or more features of the organic photo conducting drum. An analysis of the organic photo conducting drum is provided based on the identified one or more characteristics and the examined one or more features.

A system for analyzing an organic photo conducting drum in accordance with embodiments of the present invention includes an identification system, a feature examination system, and an evaluation processing system. The identification system identifies one or more characteristic relating to the organic photo conducting drum. The feature examination system examines one or more features of the organic photo conducting drum. The evaluation processing system provides an analysis of the organic photo conducting drum based on the identified one or more characteristics and the examined one or more features.

The present invention provides a system and method for determining the condition of and estimating the remaining usable life of an OPC drum. The present invention enables toner cartridge remanufacturers and others to safely determine which OPC drums can be reused without risking warranty return issues directly related to the coating thickness of the OPC drum. Additionally, the present invention provides a system and method where a high volume of OPC drums can quickly be measured and evaluated.

DETAILED DESCRIPTION

Figure 1:
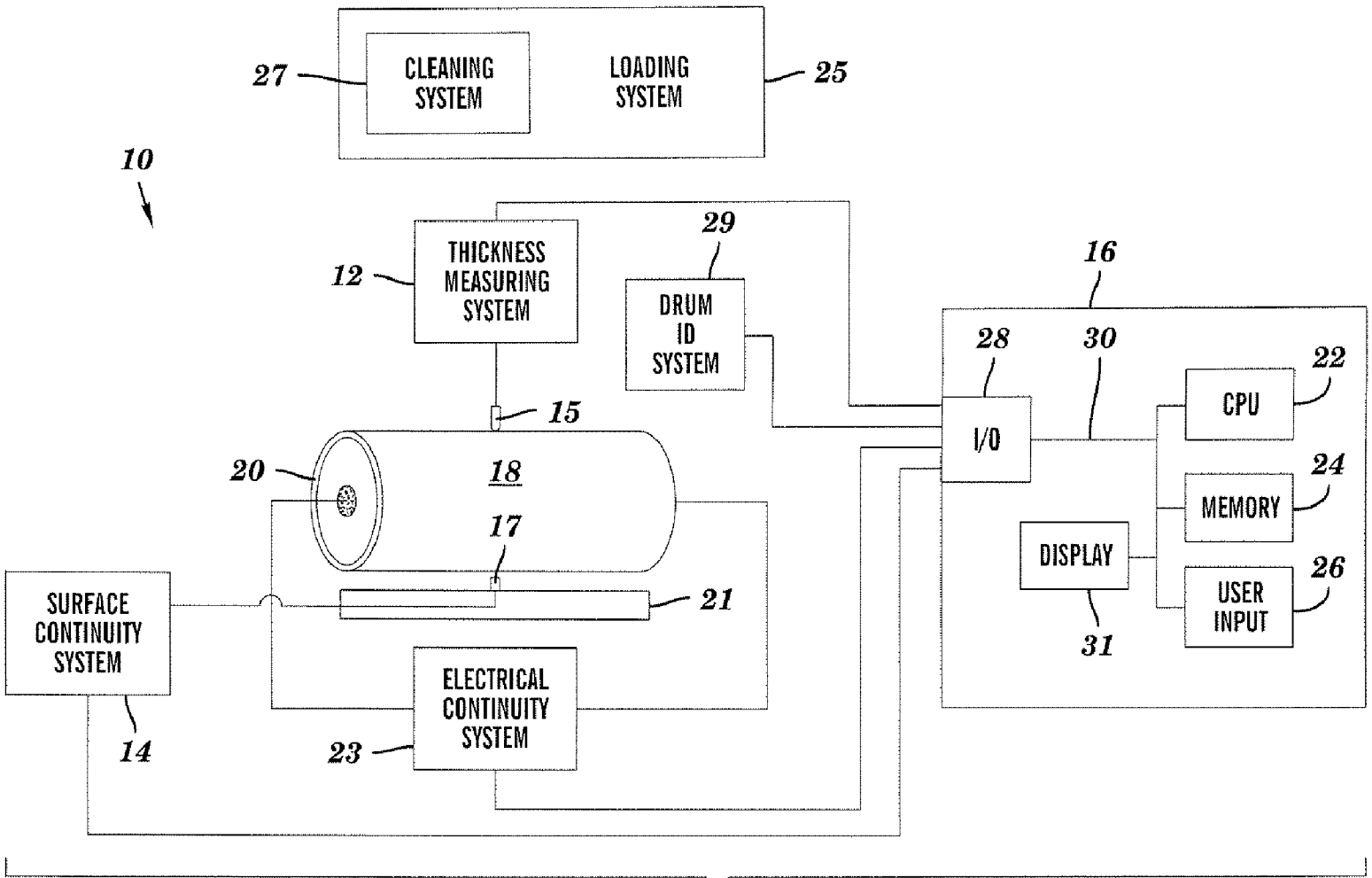
FIG. 1 is a block diagram of an analyzing system for an OPC drum in accordance with embodiments of the present invention.

An analyzing system 10 for an OPC drum 18 in accordance with embodiments of the present invention is illustrated in FIG. 1. The analyzing system 10 includes a thickness measuring system 12, a surface continuity system 14, an electrical continuity system 23, and an OPC drum evaluation system 16, although the analyzing system 10 can comprise other numbers and types of components in other configurations. The present invention provides a system and method for providing an analysis of an OPC drum.

Referring more specifically to FIG. 1, the OPC drum 18 is connected to the analyzing system 10 for rotational movement, although the OPC drum 18 can be connected to the analyzing 10 system in other manners. The OPC drum 18 includes a coating layer 20 which acts as a charge transfer layer and wears down during use in printing operations.

The thickness measuring system 12 is used to determine or measure a thickness of the coating layer 20. In this particular embodiment, the current meter system 12 is an eddy current meter system, although other types of systems to measure the thickness of the coating layer 20 on the OPC drum 18 can be used. The current meter system 12 includes a probe 15 which is positioned adjacent a known region of wear on the coating layer 20, although the current meter system 12 can comprise other numbers of probes and the measurement or measurements can be taken at other locations. The current meter system 12 retrieves the known region of wear from memory 24 in the OPC drum evaluation system 16 based on the identified manufacturer and model type for the OPC drum 18 being evaluated, although the location can be obtain in other manners.

The surface continuity system 14 comprises a probe 17 which is moved along an outer surface of the coating layer 20 by a transport system 21 to examine a substantial portion of an outer surface of coating layer on the OPC drum 18, although the system 14 can comprise other numbers of probes which scan different portions of the coating layer 20, such as just the known regions of wear, and other manners for scanning the coating layer 20, such as with a stationary probe or probes can be used. A voltage is applied across the OPC drum 18 by the electrical continuity system 23 and the probe 18 is used to identify current spikes which indicate a void in the coating layer 20, although other sources for the voltage and other techniques for checking the surface continuity of the coating layer 20 can be used. The readings from the probe 18 are transmitted to the OPC drum evaluation system 16 for evaluation.

The electrical continuity system 23 is coupled to the center of the OPC drum 18 and the outer surface of the coating layer 20 and a voltage is applied across the OPC drum 18, although other types of systems for checking electrical continuity can be used. The electrical continuity system 23 measures the voltage drop across the OPC drum 18 and transmits the reading to the OPC drum evaluation system 16 for evaluation.

The drum identification system 29 comprises a densitometer which is positioned adjacent the OPC drum 18 to take a color reading of the OPC drum, although other types of identification systems could be used. The drum identification system 29 transmits the measured color of the OPC drum 18 to the OPC drum evaluation system 16 for evaluation to determine the manufacture and the type of model of OPC drum 18, although other types of information could be determined and the OPC evaluation system 16 can obtain information about the OPC drum 18 in other manners as described below.

Figure 2:
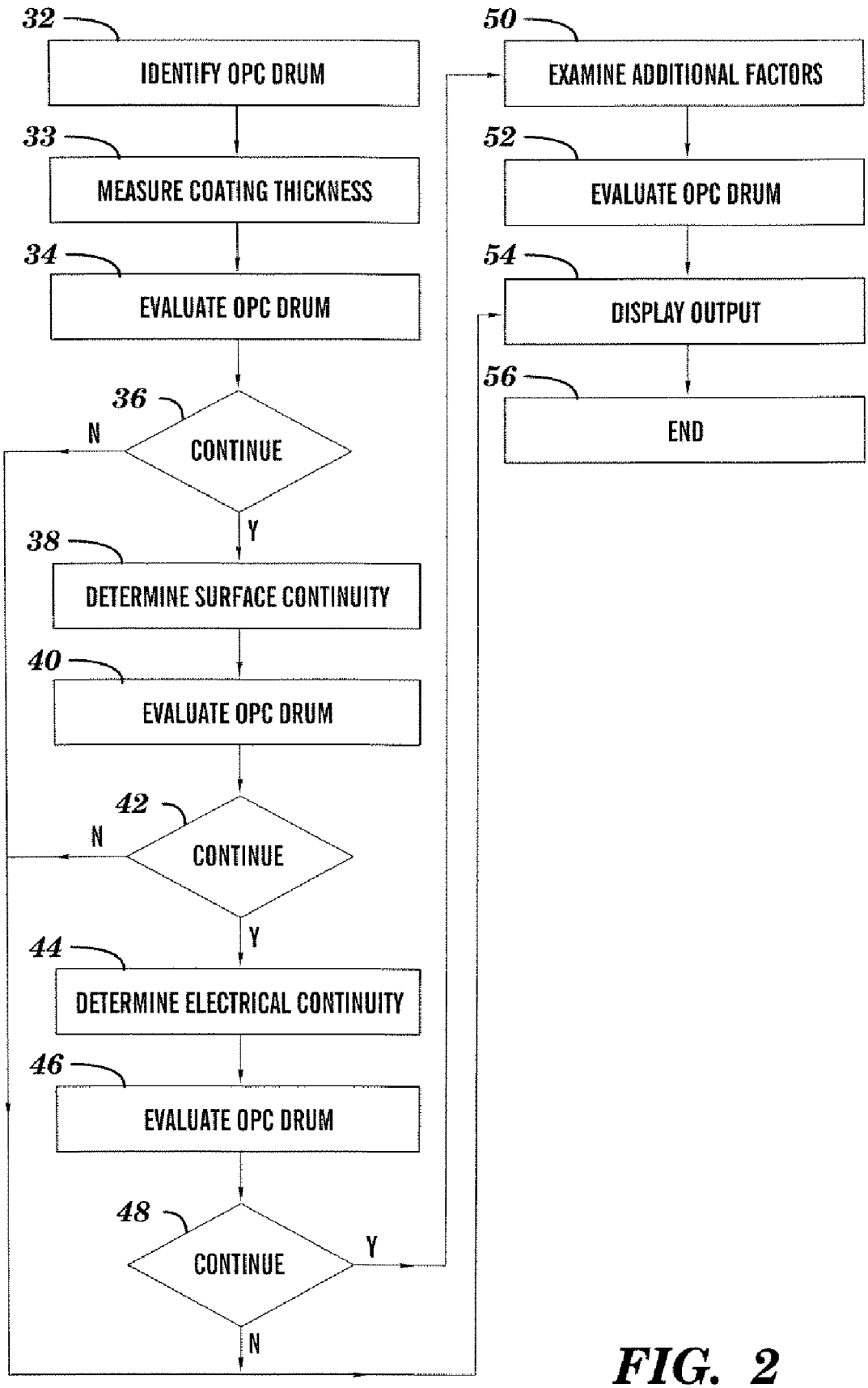
FIG. 2 is a flow chart of a method for analyzing an OPC drum in accordance with embodiments of the present invention.

The OPC drum evaluation system 16 analyzes the OPC drum 18 based on the inputs from the thickness measuring system 12, the surface continuity system 14, the electrical continuity system 23, and the drum identification system 29, although the OPC drum evaluation system 16 can base the evaluation on other numbers and types of inputs. The OPC drum evaluation system 16 includes a central processing unit (CPU) or processor 22, a memory 24, a user input device 26, an input/output (I/O) interface system 28, and a display 31 which are coupled together by a bus system or other link 30, although the OPC drum evaluation system 16 may comprise other numbers and types of components in other configurations. The CPU 22 executes a program of stored instructions for the method for analyzing an OPC drum 18 in accordance with embodiments of the present invention as described herein and as illustrated in FIG. 2. In this particular embodiment, those programmed instructions are stored in the memory 24, although some or all could be stored and retrieved from other locations. A variety of different types of memory storage devices, such as a random access memory (RAM) or a read only memory (ROM) in the system or a floppy disk, hard disk, CD ROM, or other computer readable medium which is read from and/or written to by a magnetic, optical, or other reading and/or writing system that is coupled to the CPU 22, can be used for memory 24.

The input/output interface system 28 is used to operatively couple and communicate between other components, including the thickness measuring system 12, the surface continuity system 14, the electrical continuity system 23, and the drum identification system 29. In this particular embodiment, the connection is shown as a hard wire connection, although a variety of different types of connections and communication techniques can be used to transmit signals from the thickness measuring system 12, the surface continuity system 14, the electrical continuity system 23, and the drum identification system 29 to the OPC drum evaluation system 16 and/or from the OPC drum evaluation system to the thickness measuring system 12, the surface continuity system 14, the electrical continuity system 23, and the drum identification system 29.

The user input device 26 enables an operator to generate and transmit signals or commands to the CPU 22. A variety of different types of user input devices, such as a keyboard or computer mouse, can be used. The display 31 is a cathode ray tube which is used to provide an output to the operator on the condition of the OPC drum 20, although other types of displays can be used.

Figure 3A:
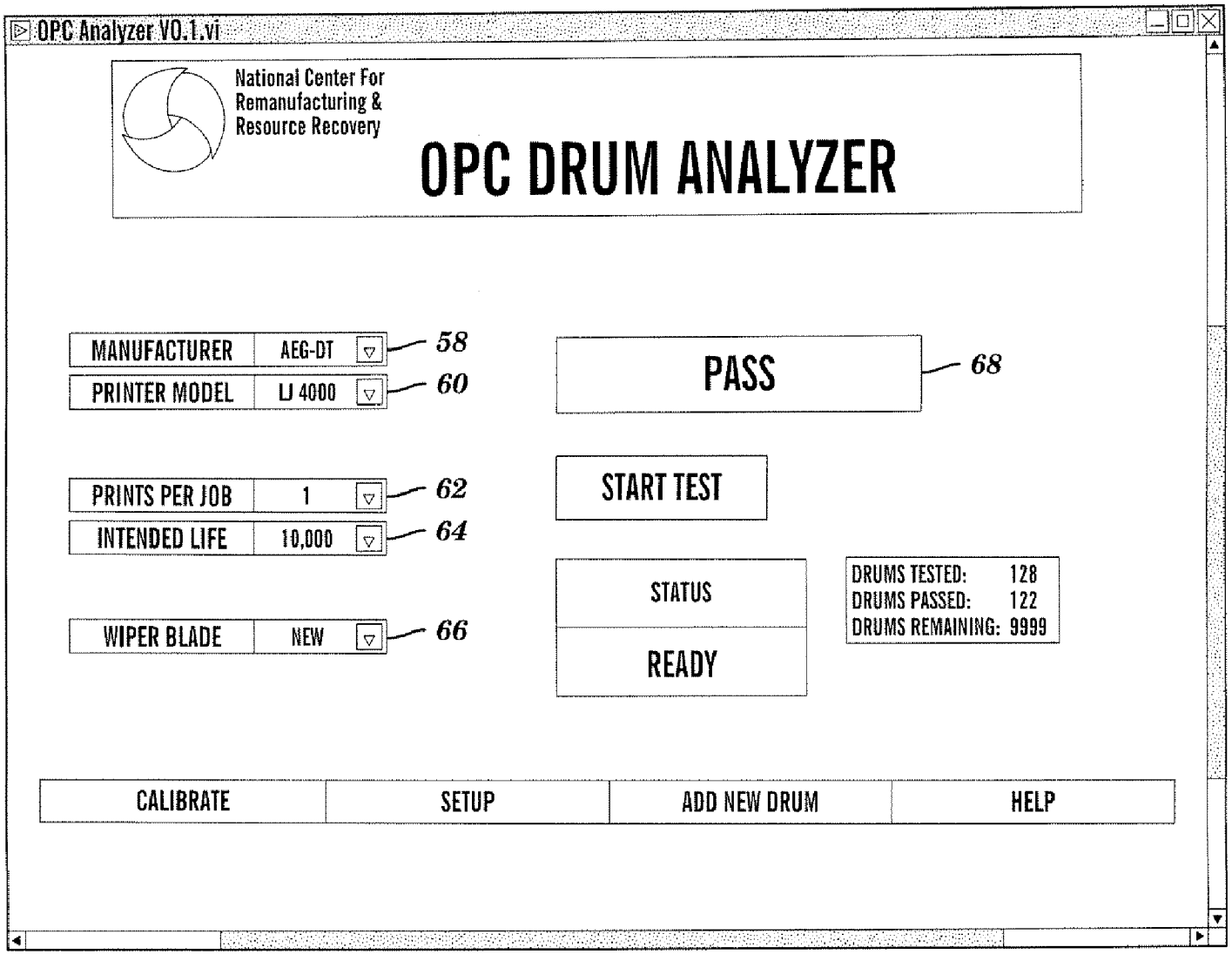
FIGS. 3A-3G are screen shots on a display of the analyzing system during an analysis in accordance with embodiments of the present invention.
Figure 3B:
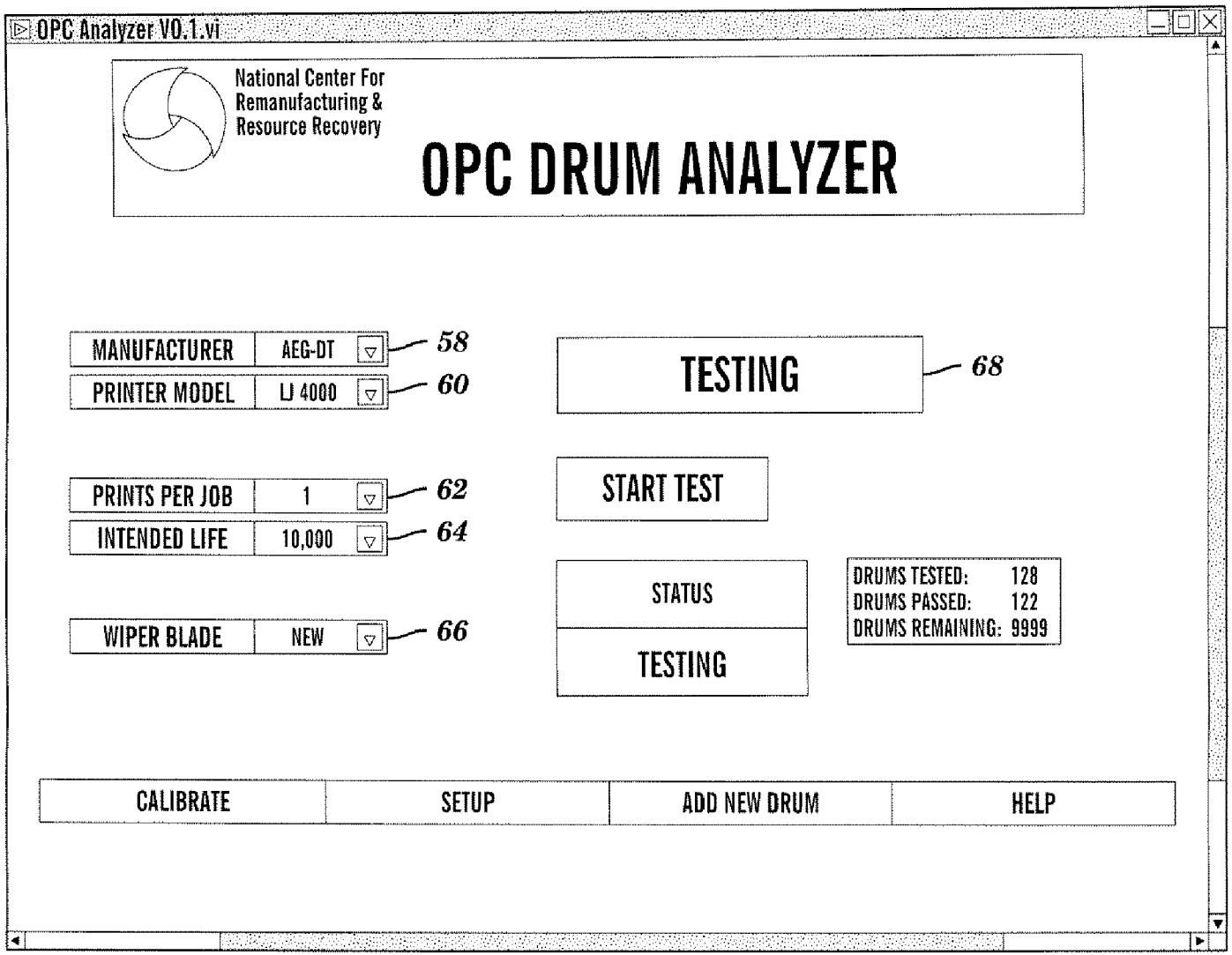
Figure 3C:
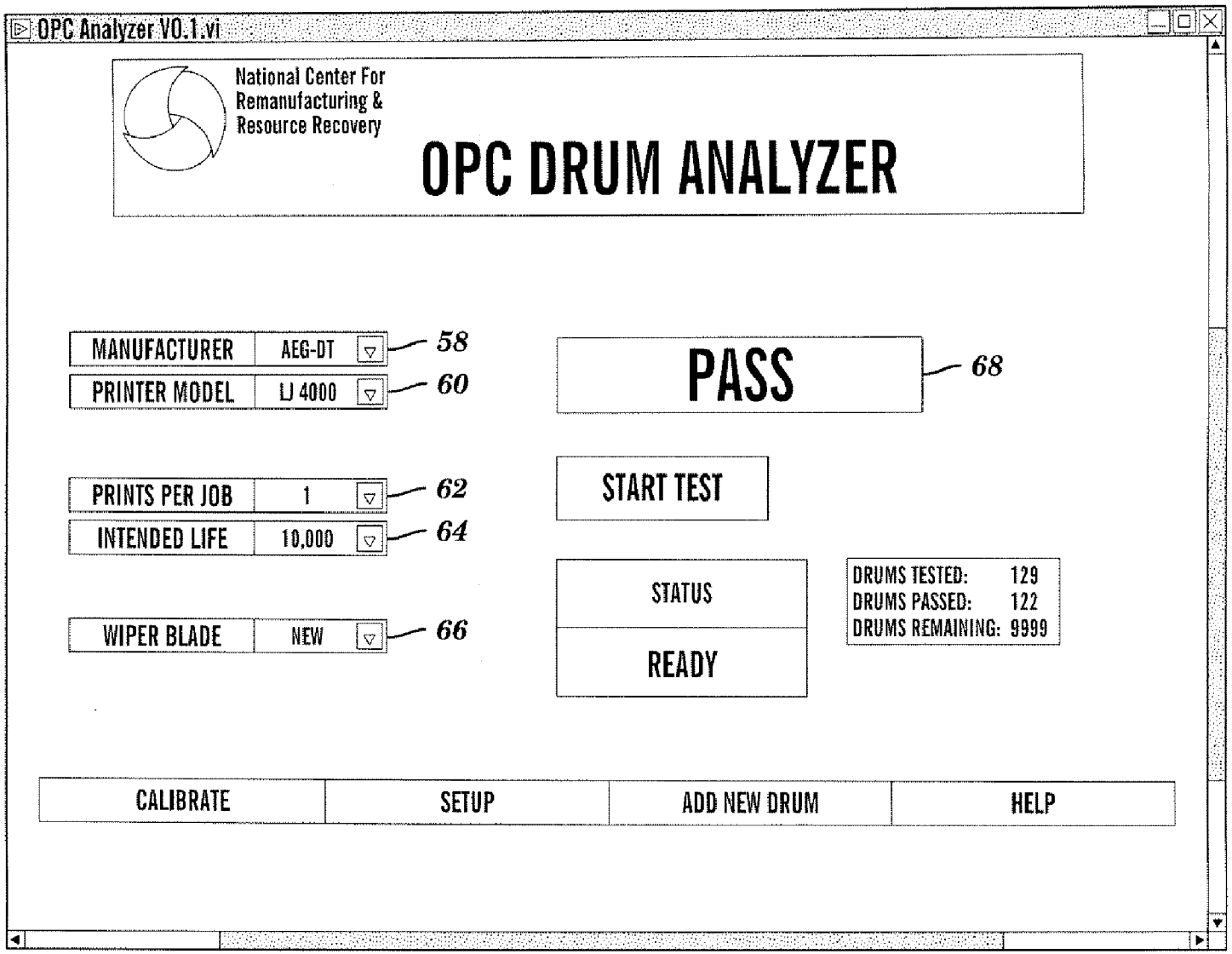
Figure 3D:
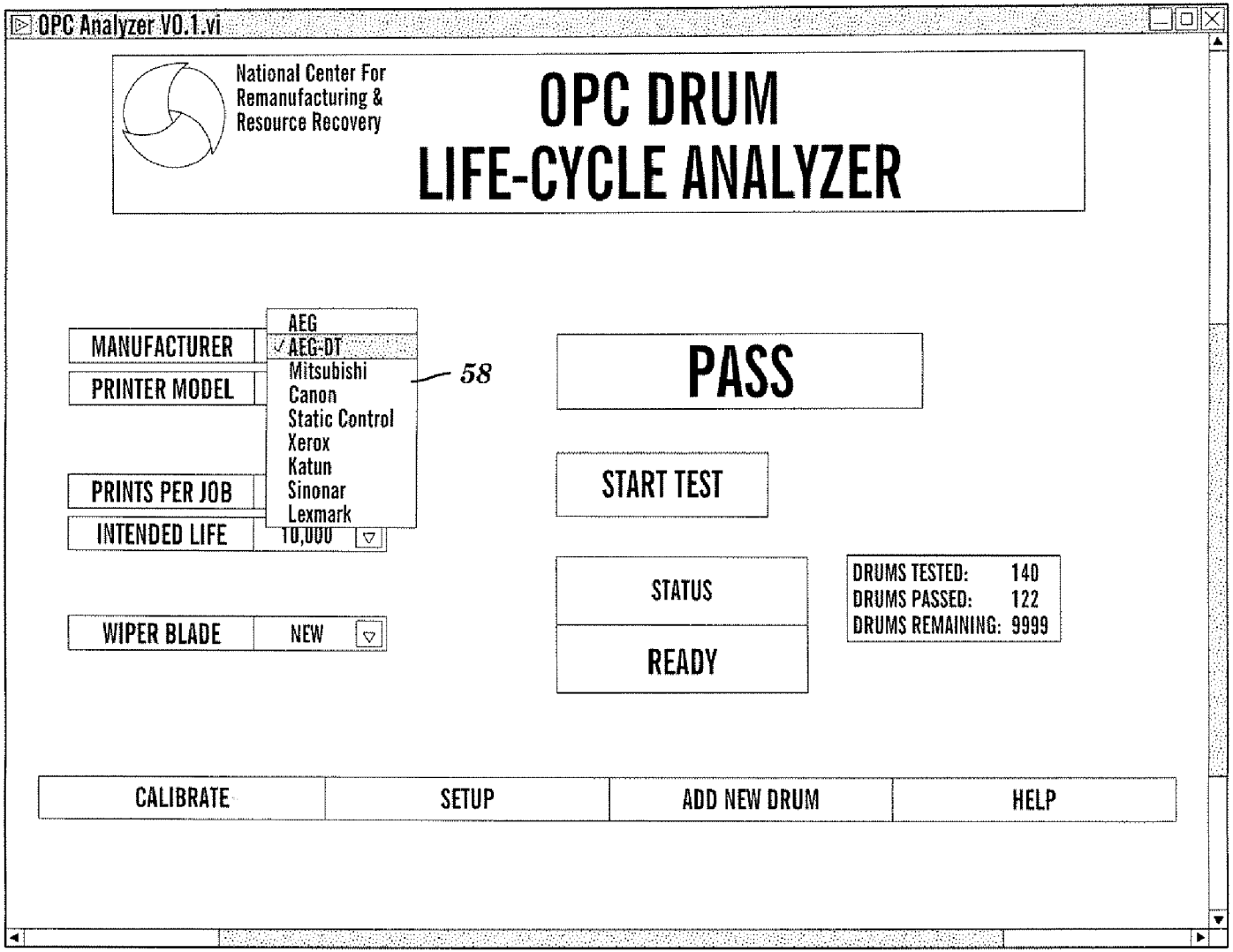
Figure 3E:
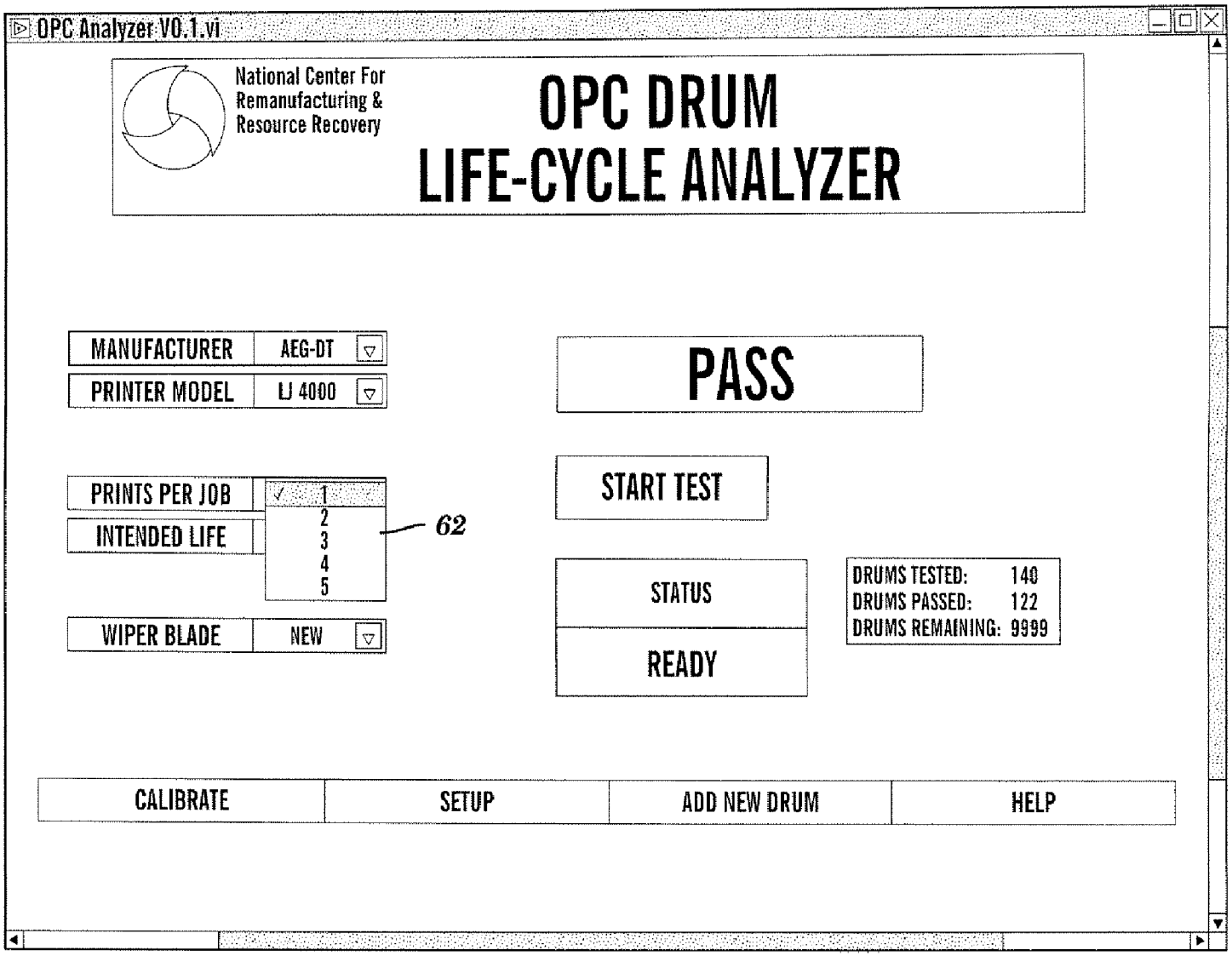
Figure 3F:
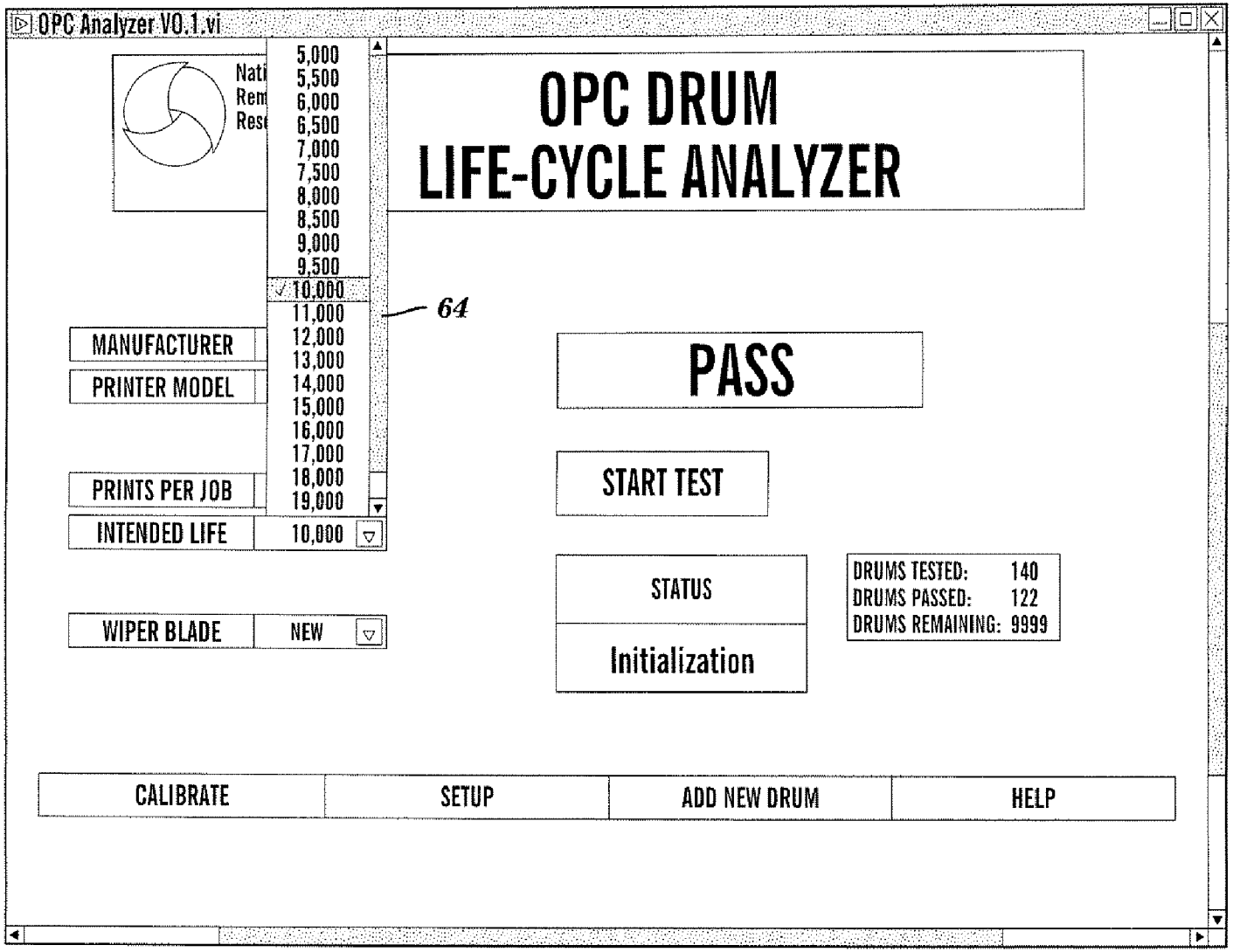
Figure 3G:
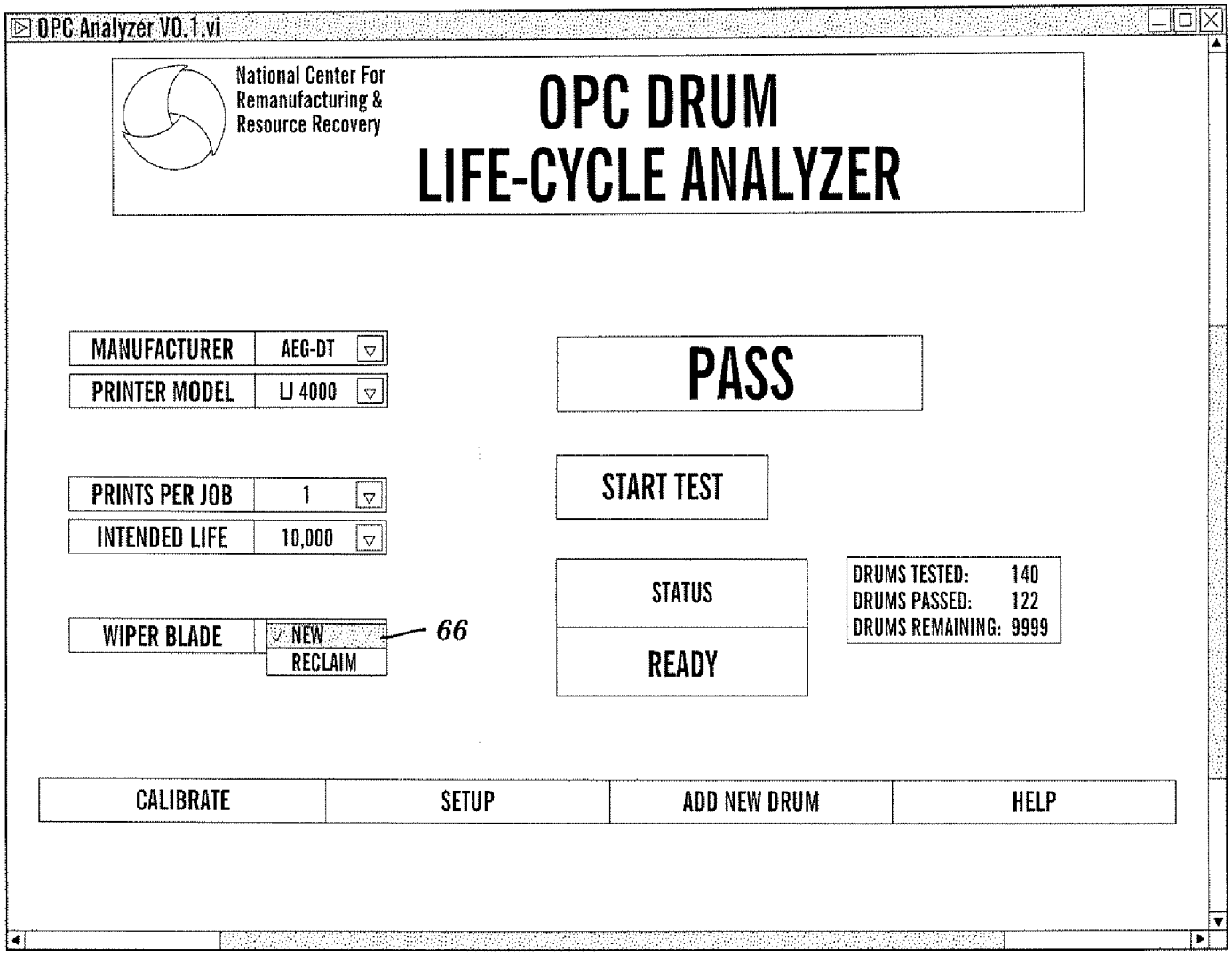

Referring to FIGS. 3A-3G, screen shots on the interactive display 31 for the analysis of an OPC drum are illustrated, although other types of displays could be used. More specifically, the display 31 has a field 68 which can display the output of the evaluation "PASS" in the color green to indicate the OPC drum 18 has another life cycle as shown in FIG. 3A, "TESTING" to indicate the OPC drum 18 is currently being examined as shown in FIG. 3B, and "FAIL" in the color red to indicate the OPC drum 18 should not be reused as shown in FIG. 3C, although OPC drum evaluation system 16 can provide other outputs, such as REUSE to indicate the OPC drum 18 has another life cycle, REMANUFACTURE to indicate the OPC drum 18 can be refurbished for further use, and RECYCLE to indicate the OPC drum should be salvaged for scrap materials. The display 31 also includes fields and drop down menus for identifying the manufacturer in field 58, the type of printer model in filed 60, the number of prints per job in field 62, the intended number of prints during a life cycle for the OPC drum in field 64, and the status of the wiper blade used on the OPC drum in field 66 as shown in FIGS. 3D-3G, although other numbers and types of fields can be used. An operator can use the user input device 26 to access and select from the drop down menus for fields 58, 60, 62, 64, and 66. The information input in fields 58, 60, 62, 64, and 66 is used by the OPC drum evaluation system 16 to evaluate the OPC drum 18.

An automated loading system 25 is used to load the OPC drum 18 into the analyzing system 10, although other devices and techniques for loading the OPC drum 18 can be used, such as loading the OPC drum 18 by hand. The automated loading system 25 may hold a plurality of the OPC drums which are individually loaded for testing. With the automated loading system 25, the OPC drum 18 is less likely to become damaged or contaminated during handling by an operator, such as from being accidentally scraped against another surface or having oils transferred from the operator's hands.

A cleaning system 27 is located in the loading system 27, although the cleaning system 27 could be in other places. The cleaning system 27 cleans the outer surface of the OPC drum 18, for example by removing any remaining toner on the OPC drum 18.

A method for analyzing an OPC drum in accordance with embodiments of the present invention will now be described with reference to FIGS. 1-3. In step 32, the analyzing system 10 identifies the OPC drum 18 being evaluated and the expected operating parameters based on the information entered in the fields 58, 60, 62, 64, and 66 in the display 31, although other numbers and types of information can be entered and the OPC drum can be evaluated in other manners. For example, the OPC drum 18 could be identified by the drum identification system 29 taking a color reading of the OPC drum 18 and transmitting the identified color back to the OPC drum evaluation system 16. The OPC drum evaluation system 18 matches the identified color to a stored color which is correlated to a particular manufacturer and model type. The manufacture and model type in fields 58 and 60 are used by the OPC drum evaluation system 16 to retrieve data about the wear rate and image quality produced by that particular type of OPC drum 18. The prints per job and the intended life cycle entered in fields 62 and 64 are used by the OPC drum evaluation system 16 to set parameters for use of the OPC drum in the next life cycle which is used in evaluating the OPC drum 18. The wiper blade status entered in field 66 is also used by the OPC drum evaluation system 16 in evaluating the OPC drum 18 because a reclaimed wiper blade will cause less wear on the OPC drum 18 during use. Although five fields are shown, other numbers and types of information to identify the OPC drum and the operating parameters can be used.

In step 33, the thickness measuring system 12 determines a thickness of the coating layer 20 on the OPC drum 18. In these embodiments, the probe 15 for the thickness measuring system 12 is positioned at a known region of wear on the OPC drum 18 to take a thickness measurement, although other locations and numbers of measurements can be taken. The position of the known region of wear is obtained by the OPC drum evaluation system 16 based on the information input in fields 58 and 60 and can be displayed on display 31 so the operator can position probe 15 or the positioning process could be automated. The thickness for the coating layer 20 measured by the probe 15 of the thickness measuring system 12 is transmitted to the OPC drum evaluation system 16, although other amounts and types of information can be transmitted to the OPC drum evaluation system 16.

In step 34, the OPC drum evaluation system 16 evaluates the OPC drum 18 based on the measured thickness and the information entered in the fields 58, 60, 62, 64, and 66, although the OPC drum evaluation system 16 can evaluate the OPC drum 18 based on other factors. For example, if the measured thickness for the coating layer 20 is thick enough to last for the intended number of prints entered in field 64, then the OPC drum evaluation system 16 would pass the OPC drum 18 through this stage. In another example, if the measured thickness for the coating layer 20 is thick enough to last for the intended number of prints entered in field 64, but the OPC drum evaluation system 16 determines that based on the manufacturer and model type for the OPC drum 18 and the prints per job entered in field 62 would result in unacceptable print quality at the measured thickness, then the OPC drum evaluation system 16 would fail the OPC drum 18 at this stage.

In step 36, the OPC drum evaluation system 16 determines whether to continue with the evaluation of the OPC drum 18. If the OPC drum 18 has failed the evaluation for measured thickness in step 34 and/or there are no more desired evaluations, then the No branch is taken to step 54 where the display 31 would provide an output in field 68 as shown in FIG. 3A or 3C based on the evaluation in step 34. If the OPC drum 18 has not failed the evaluation for measured thickness in step 34 and additional evaluations are desired, then the Yes branch is taken to step 38.

By way of example only, an evaluation of a coating layer 20 on an OPC drum 18 is described below. The thickness measuring system 12 measures the thickness of the coating layer 20 to be twenty-three microns and this is transmitted to the OPC drum evaluation system 16. Additionally, the type of OPC drum 18 is input or otherwise provided to the OPC drum evaluation system 16. The OPC drum evaluation system 16 retrieves from data stored in memory 24 that this particular type of OPC drum 18 should be capable of printing 10,000 pages and that the wear rate for the coating layer 20 for this OPC drum 18 is one micron per 1,000 pages. The OPC drum evaluation system 16 calculates that ten microns of wear will occur in one life-cycle and since the coating layer has a thickness of twenty-three microns, the OPC drum evaluation system 16 determines that the OPC drum 18 should be able to perform another life cycle without failure caused by issues with the thickness of the coating layer 20. If the OPC drum evaluation system 16 determines there is less than a life cycle left, it may signal to discard the OPC drum 18, although the OPC drum evaluation system 16 may provide other information.

In step 38, the surface continuity system 14 evaluates the surface continuity of a substantial portion of the outer surface of the coating layer 20, although other amounts of the coating layer 20 could be evaluated, such as just known regions of wear. The electrical continuity system 23 applies a voltage across the leads coupled to the center of the OPC drum 18 and to the coating layer 20. A transport system 21 moves a probe 17 along adjacent to and spaced from the outer surface of the coating layer 20 to measure for current spikes. Once the probe 17 has traversed the length of the OPC drum 18, the OPC drum 18 is rotated slightly and the probe 17 traverses the length of the OPC drum 18 measuring for current spikes. This process is repeated until the entire OPC drum 18 is scanned. The measured current spike or spikes indicate a void or voids in the coating layer 20 and are transmitted to the OPC drum evaluation system 16 for further evaluation. The size of the measured current spike or spikes provides an indication of the severity of the void or voids. Although one technique for determining surface continuity is described, other techniques for determining surface continuity can be used.

In step 40, the OPC drum evaluation system 16 evaluates the OPC drum 18 based on the determined surface continuity and the information entered in the fields 58, 60, 62, 64, and 66, although the OPC drum evaluation system 16 can evaluate the OPC drum 18 based on other factors. For example, if the determined surface continuity identified two voids whose size did not indicate any unacceptable problems with print quality based on the identified manufacturer and type of model, then the OPC drum evaluation system 16 would pass the OPC drum 18 at this stage.

In step 42, the OPC drum evaluation system 16 determines whether to continue with the evaluation of the OPC drum 18. If the OPC drum 18 has failed the evaluation for surface continuity in step 40 and/or there are no more desired evaluations, then the No branch is taken to step 54 where the display 31 would provide an output in field 68 as shown in FIG. 3A or 3C. If the OPC drum 18 has not failed the evaluation for surface continuity in step 40 and additional evaluations are desired, then the Yes branch is taken to step 44.

In step 44, the electrical continuity system 14 evaluates the electrical continuity of the OPC drum 18 with the coating layer 20, although other factors could be evaluated. The electrical continuity system 23 applies and measures a voltage across the leads coupled to the center of the OPC drum 18 and to the coating layer 20. The measured voltage is transmitted to the OPC drum evaluation system 16 for further evaluation. Although one technique for determining electrical continuity is described, other techniques can be used.

In step 46, the OPC drum evaluation system 16 evaluates the OPC drum 18 based on the determined electrical continuity and the information entered in the fields 58, 60, 62, 64, and 66, although the OPC drum evaluation system 16 can evaluate the OPC drum 18 based on other factors. For example, if the measured voltage for electrical continuity corresponds within a range which is acceptable for the identified manufacture and type of model of OPC drum 18, then the OPC drum evaluation system 16 would pass the OPC drum 18 at this stage.

In step 48, the OPC drum evaluation system 16 determines whether to continue with the evaluation of the OPC drum 18. If the OPC drum 18 has failed the evaluation for electrical continuity in step 46 and/or there are no more desired evaluations, then the No branch is taken to step 54 where the display 31 would provide an output in field 68 as shown in FIG. 3A or 3C. If the OPC drum 18 has not failed the evaluation for electrical continuity in step 46 and additional evaluations are desired, then the Yes branch is taken to step 50.

In step 50, an additional evaluation of the OPC drum 18 can be performed and then the results can be evaluated in step 52. For example, the gears of the OPC drum 18 may be examined to determine if any teeth are missing and the results of this evaluation can be transmitted to the OPC drum evaluation system 16 for further evaluation to provide an analysis of the future life of the OPC drum. To examine the gears of the OPC drum 18, a visual inspection system could be positioned adjacent each of the gears of the OPC drum 18 to inspect and identify any missing or damaged gear teeth and this information would be transmitted to the OPC drum evaluation system 16 for evaluation. The OPC drum evaluation system 16 based on visual inspection data and corresponding stored visual inspection data for gears for the identified manufacturer and model type of OPC drum 18 would determine whether the extent of the damage would preclude further use of the OPC drum 18 or require other action, such as replacement of the damaged gear or gears or recycling of the OPC drum 18. Although one example of inspecting the gears is disclosed, other types of inspection systems could be used to inspect the gears, such as a system which would measure the torque to turn the OPC drum 18 by engaging the gear of the OPC drum 18 and transmitting the measured torque data to the OPC drum evaluation system 16 for evaluation. The OPC drum evaluation system 16 based on received torque data and corresponding stored torque data for gears for the identified manufacturer and model type of OPC drum 18 would determine whether the extent of the damage would preclude further use of the OPC drum 18 or require other action, such as replacement of the damaged gear or gears or recycling of the OPC drum 18. Although examples of different evaluations or failure modes are set forth above, other numbers and types of evaluations can be performed and in other orders. In another example, two or more of the measurements and/or determinations can be made before an evaluation of the OPC drum 18 is performed.

In step 54, the field 68 in the display 31 provides an output on the results of the analysis of the OPC drum 18, although other types of displays and methods for providing the results can be used. As described earlier, in these embodiments, the provided output in field 68 is PASS or FAIL, although other types of outputs can be provided, such as REUSE, REMANUFACTURE, or RECYCLE. In step 56, the analysis of the OPC drum 18 ends.

Accordingly, the present invention provides an accurate indication of whether an OPC drum 18 has another life cycle available and can provide other information, such as recommendations to remanufacture or recycle the OPC drum 18. Additionally, the present invention is very easy to use and is able to quickly provide a reliable evaluation of the OPC drum 18.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A method for analyzing an organic photo conducting drum, the method comprising:

identifying the type of organic photo conducting drum being analyzed based on one or more characteristics of the organic photo conducting drum;

obtaining at least an intended life cycle for the identified type of organic photo conducting drum;

examining one or more features of the organic photo conducting drum, wherein the examining further comprises determining if the identified organic photo conducting drum has another life cycle based on the identified type of organic photo conducting drum, the obtained intended life cycle, and the examined one or more features; and providing an analysis of an availability of the another life cycle for the organic photo conducting drum based on the determining.

2. The method as set forth in claim 1 wherein the one or more characteristics comprise at least one of an identified manufacturer of the organic photo conducting drum, a type of model of the organic photo conducting drum, an intended number of prints per job, an intended number of pages to be printed, and a status of a wiper blade used on the organic photo conducting drum.

3. The method as set forth in claim 1 wherein the one or more features comprise at least one of a thickness of a coating layer on the organic photo conducting drum, a surface continuity for the coating layer, an electrical continuity for the organic photo conducting drum, and gear quality for the organic photo conducting drum.

4. The method as set forth in claim 1 wherein the examining further comprises determining the thickness of at least one coating layer on the organic photo conducting drum at at least one location and wherein the determining determines if the organic photo conducting drum has another life cycle based on the determined thickness.

5. The method as set forth in claim 1 wherein the examining further comprises examining a surface continuity of at least a portion of at least one coating layer, wherein the determining determines if the organic photo conducting drum has another life cycle based on the examined surface continuity.

6. The method as set forth in claim 5 wherein the examining a surface continuity further comprises identifying and characterizing any voids in the outer surface of the coating layer.

7. The method as set forth in claim 1 wherein the examining further comprises examining an electrical continuity of the organic photo conducting drum, wherein the determining determines if the organic photo conducting drum has another life cycle based on the examined electrical continuity of at least one coating layer.

8. The method as set forth in claim 1 further comprising displaying the provided analysis.

9. The method as set forth in claim 1 further comprising automatically loading the organic photo conducting drum for the examining.

10. The method as set forth in claim 1 further comprising at least partially cleaning the organic photo conducting drum.

11. The method as set forth in claim 1 further comprising displaying the provided analysis, wherein the provided analysis comprises an output recommendation that the photo conducting drum be one of pass and fail for an additional life cycle for the organic photo conducting drum.

12. A method for analyzing an organic photo conducting drum, the method comprising:

identifying the type of organic photo conducting drum being analyzed based on one or more characteristics of the organic photo conducting drum;

examining one or more features of the organic photo conducting drum; and providing an analysis of the organic photo conducting drum based on the identified type of organic photo conducting drum and the examined one or more features;

wherein the one or more characteristics comprise at least one of an identified manufacturer of the organic photo conducting drum, a type of model of the organic photo conducting drum, an intended number of prints per job, an intended number of pages to be printed, and a status of a wiper blade used on the organic photo conducting drum and wherein the identifying further comprises:

identifying a color of the organic photo conducting drum; and determining the manufacturer and the type of model of the organic photo conducting drum based on the identified color.

13. A method for analyzing an organic photo conducting drum, the method comprising:

identifying the type of organic photo conducting drum being analyzed based on one or more characteristics of the organic photo conducting drum;

examining one or more features of the organic photo conducting drum; and providing an analysis of the organic photo conducting drum based on the identified type of organic photo conducting drum and the examined one or more features;

wherein the examining further comprises determining the thickness of at least one coating layer on the organic photo conducting drum at at least one location and wherein the determining determines if the organic photo conducting drum has another life cycle based on the determined thickness;

wherein determining the thickness of the coating layer on the organic photo conducting drum further comprises identifying at least one region of known wear on the coating layer on the organic photo conducting drum based on the identified one or more characteristics, wherein the determining the thickness takes place at the identified region.

14. A method for analyzing an organic photo conducting drum, the method comprising:

identifying the type of organic photo conducting drum being analyzed based on one or more characteristics of the organic photo conducting drum;

examining one or more features of the organic photo conducting drum;

providing an analysis of the organic photo conducting drum based on the identified type of organic photo conducting drum and the examined one or more features; and displaying the provided analysis, wherein the provided analysis comprises an output recommendation that the photo conducting drum be one of pass and fail for an additional life cycle for the organic photo conducting drum.

15. A method for analyzing an organic photo conducting drum, the method comprising:

identifying the type of organic photo conducting drum being analyzed based on one or more characteristics of the organic photo conducting drum;

examining one or more features of the organic photo conducting drum;

providing an analysis of the organic photo conducting drum based on the identified type of organic photo conducting drum and the examined one or more features; and displaying the provided analysis, wherein the provided analysis comprises an output recommendation that the photo conducting drum be one of reused for another life cycle, remanufactured, and recycled.

16. A method for analyzing an organic photo conducting drum, the method comprising:

identifying the type of organic photo conducting drum being analyzed based on one or more characteristics of the organic photo conducting drum;

examining one or more features of the organic photo conducting drum; and providing an analysis of the organic photo conducting drum based on the identified type of organic photo conducting drum and the examined one or more features, wherein the examining further comprises examining one or more gears of the organic photo conducting drum, wherein the determining determines if the organic photo conducting drum has another life cycle based on the examined one or more gears.

17. A system for analyzing an organic photo conducting drum, the system comprising:

an identification system that identifies the type of organic photo conducting drum being analyzed based on one or more characteristics of the organic photo conducting drum and obtains at least an intended life cycle for the identified type of organic photo conducting drum;

a feature examination system that examines one or more features of the organic photo conducting drum, wherein the feature examination system determines if the identified organic photo conducting drum has another life cycle based on the identified type of organic photo conducting drum, the obtained intended life cycle, and the examined one or more features; and an evaluation processing system that provides an analysis of an availability of the another life cycle for the organic photo conducting drum based on the determination of the feature examination system.

18. The system as set forth in claim 17 wherein the one or more characteristics comprise at least one of an identified manufacturer of the organic photo conducting drum, a type of model of the organic photo conducting drum, an intended number of prints per job, an intended number of pages to be printed, and a status of a wiper blade used on the organic photo conducting drum.

19. The system as set forth in claim 18 wherein the one or more features comprise at least one of a thickness of a coating layer on the organic photo conducting drum, a surface continuity for the coating layer, an electrical continuity for the organic photo conducting drum, and gear quality for the organic photo conducting drum.

20. The system as set forth in claim 17 wherein the feature examination system further comprises a thickness determination system that determines the thickness of at least one coating layer on the organic photo conducting drum at at least one location and wherein the evaluation processing system determines if the organic photo conducting drum has another life cycle based on the determined thickness.

21. The system as set forth in claim 17 wherein the feature examination system further comprises a surface examination system that examines a surface continuity of at least a portion of at least one coating layer, wherein the evaluation processing system determines if the organic photo conducting drum has another life cycle based on the examined surface continuity.

22. The system as set forth in claim 21 wherein the surface examination system further comprises a void detection system that identifies and characterizes any voids in an outer surface of the coating layer.

23. The system as set forth in claim 17 wherein the feature examination system further comprises an electrical continuity system that examines an electrical continuity of the organic photo conducting drum, wherein the evaluation processing system determines if the organic photo conducting drum has another life cycle based on the examined electrical continuity of at least one coating layer.

24. The system as set forth in claim 17 further comprising a display that displays the provided analysis.

25. The system as set forth in claim 17 further comprising an automated loading system that automatically loads the organic photo conducting drum for the examining.

26. The system as set forth in claim 25 further comprising a cleaning system that at least partially cleans the organic photo conducting drum.

27. The system as set forth in claim 17 further comprising a display system that displays the provided analysis, wherein the provided analysis comprises an output recommendation that the photo conducting drum be one of pass and fail for an additional life cycle for the organic photo conducting drum.

28. A system for analyzing an organic photo conducting drum, the system comprising:

an identification system that identifies the type of organic photo conducting drum being analyzed based on one or more characteristics of the organic photo conducting drum;

a feature examination system that examines one or more features of the organic photo conducting drum; and an evaluation processing system that provides an analysis of the organic photo conducting drum based on the identified type of organic photo conducting drum and the examined one or more features;

wherein the one or more characteristics comprise at least one of an identified manufacturer of the organic photo conducting drum, a type of model of the organic photo conducting drum, an intended number of prints per job, an intended number of pages to be printed, and a status of a wiper blade used on the organic photo conducting drum and wherein the identification system further comprises:

a color identification system that identifies a color of the organic photo conducting drum; and a determination processing system that determine the manufacturer and the type of model of the organic photo conducting drum based on the identified color.

29. A system for analyzing an organic photo conducting drum, the system comprising:

an identification system that identifies the type of organic photo conducting drum being analyzed based on one or more characteristics of the organic photo conducting drum;

a feature examination system that examines one or more features of the organic photo conducting drum; and an evaluation processing system that provides an analysis of the organic photo conducting drum based on the identified type of organic photo conducting drum and the examined one or more features;

wherein the feature examination system further comprises a thickness determination system that determines the thickness of at least one coating layer on the organic photo conducting drum at at least one location and wherein the evaluation processing system determines if the organic photo conducting drum has another life cycle based on the determined thickness;

wherein determination system further comprises a locator system that identifies at least one region of known wear on the coating layer on the organic photo conducting drum based on the identified one or more characteristics, wherein the feature examination system determines the thickness at the identified region.

30. A system for analyzing an organic photo conducting drum, the system comprising:

an identification system that identifies the type of organic photo conducting drum being analyzed based on one or more characteristics of the organic photo conducting drum;

a feature examination system that examines one or more features of the organic photo conducting drum; and an evaluation processing system that provides an analysis of the organic photo conducting drum based on the identified type of organic photo conducting drum and the examined one or more features;

a display that displays the provided analysis, wherein the provided analysis comprises an output recommendation that the photo conducting drum be one of pass and fail for an additional life cycle for the organic photo conducting drum.

31. A system for analyzing an organic photo conducting drum, the system comprising:

an identification system that identifies the type of organic photo conducting drum being analyzed based on one or more characteristics of the organic photo conducting drum;

a feature examination system that examines one or more features of the organic photo conducting drum; and an evaluation processing system that provides an analysis of the organic photo conducting drum based on the identified type of organic photo conducting drum and the examined one or more features;

a display that displays the provided analysis, wherein the provided analysis comprises an output recommendation that the photo conducting drum be one of reused for another life cycle, remanufactured, and recycled.

32. A system for analyzing an organic photo conducting drum, the system comprising:

an identification system that identifies the type of organic photo conducting drum being analyzed based on one or more characteristics of the organic photo conducting drum;

a feature examination system that examines one or more features of the organic photo conducting drum; and an evaluation processing system that provides an analysis of the organic photo conducting drum based on the identified type of organic photo conducting drum and the examined one or more features, wherein the feature examination system further comprises a gear examination system that examines one or more gears of the organic photo conducting drum, wherein the evaluation processing system determines if the organic photo conducting drum has another life cycle based on the examined one or more gears.

* * * * *